US005908473A

United States Patent [19]

Weller et al.

[11] Patent Number: 5,908,473

[45] **Date of Patent: *Jun. 1, 1999**

[54] SPOT PRETREATMENT COMPOSITIONS FOR HOME DRY CLEANING

[75] Inventors: Jeanne Marie Weller, Glen Rock; Frank Anthony Lucia, III, Oak Ridge; Stanislaw Kepka, Ringoes; Ashwinkumar C. Gandhi, Toms River, all of N.J.

[73] Assignee: Reckitt & Colman, Wayne, N.J.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/666,690

[22] Filed: Jun. 18, 1996

[30] Foreign Application Priority Data

Mar. 7, 1996 [GB] United Kingdom ..... 9604883

[51] Int. Cl.[6] ..... C11D 3/26; C11D 7/32; D06L 1/16

[52] U.S. Cl. ..... 8/142; 8/137; 510/281; 510/282; 510/283; 510/284; 510/285; 510/289; 510/291; 510/293; 510/295; 510/297; 510/277

[58] Field of Search ..... 8/137, 142; 510/281, 510/277, 282, 283, 284, 285, 289, 291, 293, 295, 297

[56] References Cited

U.S. PATENT DOCUMENTS

| | | | |
|---|---|---|---|
| 2,327,182 | 8/1943 | Flett . | |
| 2,327,183 | 8/1943 | Flett . | |
| 2,697,075 | 12/1954 | Echols . | |
| 3,067,144 | 12/1962 | Michaels . | |
| 3,401,007 | 9/1968 | Hoffman et al. | 8/137 |
| 3,432,253 | 3/1969 | Dixon et al. | 8/142 |
| 3,697,453 | 10/1972 | Tate et al. . | |
| 3,748,268 | 7/1973 | Loudas . | |
| 3,761,429 | 9/1973 | Yamano et al. . | |
| 3,813,221 | 5/1974 | Stubits | 8/142 |
| 3,859,225 | 1/1975 | McKnight et al. . | |
| 3,910,855 | 10/1975 | Abeles . | |
| 3,920,389 | 11/1975 | Eanzel | 510/285 |
| 3,953,353 | 4/1976 | Barrett, Jr. et al. . | |
| 3,985,502 | 10/1976 | Boorujy et al. | 8/137 |
| 4,095,946 | 6/1978 | Jones et al. | 8/137 |
| 4,097,397 | 6/1978 | Mizutani et al. | 510/289 |
| 4,105,592 | 8/1978 | Collins . | |
| 4,105,813 | 8/1978 | Mizuno | 428/76 |
| 4,113,630 | 9/1978 | Hagner et al. | 252/8.6 |
| 4,199,482 | 4/1980 | Renaud et al. | 252/559 |
| 4,206,070 | 6/1980 | Jones | 252/174.21 |
| 4,231,744 | 11/1980 | Moot | 8/495 |
| 4,336,024 | 6/1982 | Denissenko et al. | 510/289 |
| 4,390,466 | 6/1983 | Weinberger | 252/548 |
| 4,430,468 | 2/1984 | Schumacher . | |
| 4,434,090 | 2/1984 | Hampson et al. | 252/547 |
| 4,435,346 | 3/1984 | Ito et al. . | |
| 4,490,285 | 12/1984 | Kebanli | 252/551 |
| 4,548,954 | 10/1985 | Smith et al. | 521/52 |
| 4,563,483 | 1/1986 | Smith et al. | 521/111 |
| 4,594,362 | 6/1986 | Smith et al. | 521/52 |
| 4,613,646 | 9/1986 | Sandvick . | |
| 4,632,772 | 12/1986 | Garabedian et al. . | |
| 4,670,171 | 6/1987 | Magyar . | |
| 4,680,143 | 7/1987 | Edge et al. . | |
| 4,685,930 | 8/1987 | Kasprzak | 8/139.1 |
| 4,720,351 | 1/1988 | Flynn et al. . | |
| 4,734,221 | 3/1988 | Edwards et al. | 252/544 |
| 4,738,791 | 4/1988 | Ertle . | |
| 4,738,792 | 4/1988 | Ertle . | |

(List continued on next page.)

FOREIGN PATENT DOCUMENTS

| | | |
|---|---|---|
| 0 429 172 A1 | 5/1991 | European Pat. Off. . |
| 26 28 480 | 1/1978 | Germany . |
| 1 471 886 | 4/1977 | United Kingdom . |
| 1 536 936 | 12/1978 | United Kingdom . |
| 1 598 911 | 9/1981 | United Kingdom . |
| 2 169 916 | 7/1986 | United Kingdom . |
| WO 91/14038 | 9/1991 | WIPO . |
| WO 95/31523 | 11/1995 | WIPO . |

OTHER PUBLICATIONS

Copy of PCT Search Report dated Dec. 26, 1996 for PCT/US96/10559.

Copy of GB Search Report dated May 29, 1996 for GB Application No. 9604828.5.

Copy of GB Search Report dated Jul. 2, 1996 for GB Application No. 9604849.1.

Copy of GB Search Report dated Oct. 29, 1996 for GB Application No. 9612979.6.

Copy of GB Search Report dated May 29, 1996 for GB Application No. 9604880.6.

Copy of GB Search Report dated Jul. 3, 1996 for GB Application No. 9604884.8.

Copy of GB Search Report dated May 23, 1996 for GB Application No. 9612879.8.

Copy of GB Search Report dated Oct. 30, 1996 for GB Application No. 9612980.4.

Copy of International Search Report dated Nov. 29, 1996 for Application No. PCT/US96/10558.

Copy of International Search Report dated Dec. 26, 1996 for Application No. PCT/US96/10559.

Copy of International Search Report dated Nov. 26, 1996 for Application No. PCT/US96/10556.

*Primary Examiner*—Alan Diamond
*Attorney, Agent, or Firm*—Fish & Richardson, P.C.

[57] ABSTRACT

Spot pretreatment compositions useful as stain cleaning compositions useful prior to a subsequent cleaning operation, including laundering or dry-cleaning. The spot cleaning compositions feature a major proportion of water, and minor amounts of nonionic surfactants, anionic surfactants, and organic solvents selected from alcohols and glycol ethers. The spot pretreatment compositions exhibit excellent stain dissolution characteristics. Processes for producing the spot cleaning compositions, and methods for their use are also disclosed.

33 Claims, No Drawings

U.S. PATENT DOCUMENTS

| | | | |
|---|---|---|---|
| 4,784,800 | 11/1988 | Leng et al. | 252/548 |
| 4,834,900 | 5/1989 | Soldanski et al. . | |
| 4,861,516 | 8/1989 | Kurzendoerfer et al. | 252/531 |
| 4,880,569 | 11/1989 | Leng et al. . | |
| 4,909,962 | 3/1990 | Clark | 252/547 |
| 4,954,286 | 9/1990 | Sepulveda et al. . | |
| 4,992,107 | 2/1991 | Itoku et al. | 134/27 |
| 5,055,215 | 10/1991 | Mains et al. | 8/142 |
| 5,205,960 | 4/1993 | Kristopeit et al. . | |
| 5,238,587 | 8/1993 | Smith et al. | 510/277 |
| 5,290,472 | 3/1994 | Michael . | |
| 5,411,674 | 5/1995 | Tagata et al. . | |
| 5,415,811 | 5/1995 | Wile et al. . | |
| 5,454,969 | 10/1995 | Fields et al. . | |
| 5,472,455 | 12/1995 | Mehreteab et al. | 8/137 |
| 5,474,713 | 12/1995 | Faber . | |
| 5,492,540 | 2/1996 | Leifheit et al. | 8/111 |
| 5,496,492 | 3/1996 | Hamada et al. . | |
| 5,538,664 | 7/1996 | Michael | 510/217 |
| 5,547,476 | 8/1996 | Siklosi et al. | 8/142 |
| 5,559,091 | 9/1996 | Geboes et al. | 510/422 |

SPOT PRETREATMENT COMPOSITIONS FOR HOME DRY CLEANING

The present invention relates to spot pretreating compositions which is particularly useful in a localized stain cleaning pretreatment step prior to the subsequent dry-cleaning or laundering of textiles and garments. More particularly the present invention relates to spot pretreatment compositions particularly useful in dry-cleaning of textiles and garments in both commercial, as well as a non-commercial environment, i.e., a domestic environment.

As is well known to the art, textiles and garments are produced from a variety of different and distinctive fibers such as naturally produced fibers including cotton, wool, silk, as well as synthetically produced fibers including spun polymeric fibers. These fibers may be used individually, but are also encountered in blends of two or more differing types of fibers.

Typically garments produced from such textile materials ultimately become stained due to normal wear and tear associated with the use of a garment. Generally, one of two techniques may be used in order to remove the stains from such a garment and these include laundry operations as well as dry cleaning operations. The former requires that the garment be totally immersed in a washing medium, typically an aqueous wash bath which includes an effective amount of a detergent agent. However, such a laundering operation is not suitable for many types of textiles and/or garments produced therefrom and such a laundering technique may undesirably deform, discolor or otherwise change the appearance and/or form of the textile and/or garment. In such cases, a dry cleaning technique is generally utilized and such a technique typically one or more volatile organic solvents such as perchloroethylene and trichloroethylene are used as a cleaning medium. Such organic solvents are selected as they are known to have good stain releasing characteristics as well as typically possessing a high evaporation rate (or conversely a low boiling point) such that they readily volatilize after their application.

One of the disadvantages of such a dry cleaning process as presently known is that generally a consumer wishing for garments to be cleaned in accordance to a dry cleaning process must have this operation performed by a commercial establishment. This is due in large part to the fact that such known useful organic solvents having such high volatility are inappropriate for use in the home as they tend to release vapors which are deleterious to human health. Such commercial cleaning establishments are suited for the performance of such typical dry cleaning operations as they may exert a very strict control over the solvents used in the process as well as having means for recovering such volatilized solvents from the ambient prior to their release to the environment. Such a release would be very undesirable from ecological considerations.

While such cleaning establishments are well known and are generally numerous, consumers nonetheless generally find the necessity of taking their garments needing dry cleaning to such an establishment is an inconvenience due to several factors. This includes the necessity of transporting said garments to and from such an establishment, the necessity of the lag time associated with the cleaning process which can be from several hours to several days. Another concern which is often harbored by consumers is the knowledge that such a commercial dry cleaning establishment recycles the solvent, that the consumers personal garments risk the infestation by entrained microbes, such as bacteria fungi and viruses which may be entrained in such a recycled solvent. Also, the mere portage of garments requiring dry cleaning to such a commercial dry cleaning establishment is also a source of personal inconvenience.

Various processes also for the individualized dry cleaning of garments in a domestic, i.e., home setting, have also been proposed in the art, including U.S. Pat. No. 3,432,253, U.S. Pat. No. 4,336,024, U.S. Pat. No. 5,238,587 as well as in EP 518901, JP 63260592 and GB 1598911. These prior art documents illustrate various alternative processes and/or devices for dry cleaning of garments in a domestic environment. However, each of these is not without its technical shortcomings, including the problem of providing effective cleaning, particularly at the locus of a stain on such a garment.

It is therefore among the objects of the invention to provide an improved spot pretreatment composition which is particularly useful for the pretreatment of stains prior to a subsequent laundry or dry cleaning operation.

It is a further object of the invention to provide an improved spot pretreatment composition which is particularly useful for the pretreatment of stains prior to a home dry cleaning operation.

It is a further object of the invention to provide improvements to spot pretreatment composition which feature stain releasing efficacy while simultaneously featuring a high aqueous content concurrently with low amounts of volatile organic solvents. Such spot pretreatment composition are particularly suited to be used in a domestic dry cleaning operation as they feature low amounts of volatilizable solvents.

It is still another object of the invention to provide a home dry cleaning kit which comprises the spot pretreatment compositions.

Also, the present invention includes among its objects improved processes for the pretreatment of stains on a textile or garment, which includes the step of applying an effective amount of the spot pretreatment compositions according to the invention, prior to dry cleaning the stained textile and/or garment, especially in a domestic environment.

These and other objects of the invention are satisfied in accordance with the present invention which is described in more detail below.

In accordance with one aspect of the invention there is provided a spot pretreatment composition comprising the following constituents, in percent by weight:

0.1–10% nonionic alkoxylated alcohol;

0.1–10% nonionic alkoxylated mono- and/or di-alkanol amide;

0.1–3.5% anionic surfactant;

0–1% fluorosurfactant;

0.01–7% alcohol solvent;

0.01–30% glycol ether solvent;

to 100% water.

The spot pretreatment compositions may also include one or more optional constituents including coloring agents, fragrances (whether natural or synthetically produced), fragrance adjuvants and/or fragrance solubilizers, viscosity modifying agents, thickeners, gelling agents, bleaching and optical brightening agents, pH adjusting agents, pH buffers, water softening agents, biocides, preservatives, as well as further solubilizing agents as well as other conventional constituents in minor amounts, generally up to about 5% wt., but desirably no more than about 2% wt. and even less.

The liquid cleaning compositions according to the present invention which are suited for use a home dry cleaning compositions include specific amounts of one or more nonionic surfactants, of which are preferred water soluble nonionic alkoxylated alcohols and alkoxylated phenols many of which are known to the art and available in nonionic surfactant preparations. Such nonionic surfactants are known to the art, and include one or more alkoxylated phenols, such as ethoxylated phenols, as well as ethoxylated and/or propoxylated alcohols formed by condensation of either an alkyl phenol or an aliphatic alcohol with sufficient ethylene oxide and/or propylene. Such ethoxylated alcohols, propoxylated alchohols and ethoxylated phenols, are well known and may be formed by condensation of an alkyl phenol, an aliphatic alcohol, or mixtures thereof, with sufficient ethylene oxide to produce a compound having a polyoxyethylene. The alcohols may be primary, secondary or tertiary alcohols. Preferably the number of ethylene oxide units are present in an amount sufficient to insure solubility of the compound in an aqueous composition of this invention or in any dilution thereof. More preferably the ethoxylated alcohols and phenols are produced by condensation of about 4–16 (more preferably 8–13), moles of ethylene oxide with 1 mole of the parent compound (i.e. alkyl phenol or aliphatic alcohol). As known to those skilled in the art, the number of moles of ethylene oxide which are condensed with one mole of parent compound depends upon the molecular weight of the hydrophobic portion of the condensation product. The parent compounds that may be combined with the ethylene oxide may include one or more of the following:

(A) an alkyl phenol having about 1–15, and preferably 7–10, carbon atoms (saturated or unsaturated) in the alkyl group [including phenol, methyl phenol (cresol), ethyl phenol, hexyl phenol, octyl phenol, declphenol, nonylphenol, dodecylphenol, and the like]; and (B) a primary, secondary, or tertiary aliphatic alcohol having about 10–20, and preferably 11–15, carbon atoms, (including decyl alcohol, dodecyl alcohol, tridecyl alcohol, hexadecyl alcohol, octadecyl alcohol, and the like).

Illustrative examples of these preferred water soluble nonionic ethoxylated phenols and/or ethoxylated alcohols surfactants include one or more of those available under the tradename of NEODOL, presently commercially available from the Shell Oil Company; TERGITOL, presently commercially available from Union Carbide, and POLYTERGENT, presently commercially available from the Olin Chemical Co., and IGEPAL presently commercially available from the Rhône-Poulenc Co. Specific examples of such useful nonionic surfactants include NEODOL 25-3, which is believed to be a linear $C_{12}$–$C_{15}$ linear primary alcohol condensed with 3 moles of ethylene oxide per mole of alcohol; NEODOL 25-7, which is believed to be a linear $C_{12}$–$C_{15}$ linear primary alcohol condensed with 7 moles of ethylene oxide per mole of alcohol; NEODOL 25-9, which is believed to be a linear $C_{12}$–$C_{15}$ linear primary alcohol condensed with 9 moles of ethylene oxide per mole of alcohol; NEODOL 25-12, which is believed to be a linear $C_{12}$–$C_{15}$ linear primary alcohol condensed with 12 moles of ethylene oxide per mole of alcohol; TERGITOL 15-S-7, believed to be a random secondary $C_{11}$–$C_{15}$ alcohol condensed with 7 moles of ethylene oxide per mole of alcohol; TERGITOL 15-S-9, believed to be an alkoxypolyethylenoxyethanol which may be represented by the formula $C_{11\text{-}15}H_{23\text{-}31}O(CH_2CH_2O)_xH$ having a degree of ethoxylation on a mole/mole average of 8.9, POLYTERGENT SL-22, believed to be an alkoxylated linear aliphatic alcohol; POLYTERGENT SL-62, also believed to be an alkoxylated linear aliphatic alcohol, as well as mixtures thereof. Exemplary alkoxylated alkyl phenols include those presently commercially available under the trade name IGEPAL, and which are described to be octyl and nonyl phenols. Specific compositions include: IGEPAL CA-210 which is described as an ethoxylated octyl phenol having an average of 1.5 ethoxy groups groups per molecule, and IGEPAL CA-420 which is described as an ethoxylated octyl phenol having an average of 3 ethoxy groups groups per molecule.

Generally, the more water soluble nonionic alkoxylated phenols and/or alkoxylated alcohols surfactant constituent is a single surfactant, or may be a mixture of such surfactants, which are desirably included in the spot pretreatment compositions in an amount ranging from about 0.1 to about 10 weight percent, based on the total weight of the spot pretreatment composition. Most preferably, the more water soluble nonionic alkoxylated phenols and/or alkoxylated alcohols surfactant is employed in an amount ranging from about 0.1 to about 9 weight percent, and most preferably, from 2 to 7 weight percent.

As a further essential constituent, the spot pretreatment compositions according to the present invention include specific amounts of one or more water soluble, nonionic surfactant compositions based on alkoxylated alkanolamides which specifically include both alkoxylated monoalkanolamides and alkoxylated dialkanolamides. Particularly usef ul alkoxylated dialkanolamides include $C_8$–$C_{24}$alkyl-di($C_2$–$C_3$ alkanol amides). Also useful as those which may be represented by the following formula:

$$R_1—CO—NH—R_2—OH$$

wherein $R_1$ is a branched or straight chain $C_8$–$C_{24}$ alkyl radical, preferably a $C_{10}$–$C_{16}$ alkyl radical and more preferably a $C_{12}$–$C_{14}$ alkyl radical, and $R_2$ is a $C_1$–$C_4$ alkylene radical, preferably an ethyl radical.

Useful alkoxylated monoalkanolamides and alkoxylated dialkanolamides are presently commercially available and include for example one or more of those available under the tradename of MONAMID, presently commercially available from Mona Industries, Inc.; ALKAMIDE, presently commercially available from Rhône-Poulenc Co., as well as NINOL, presently commercially available from Stepan Chemical Co. Particularly are to be mentioned MONAMID 716 which is described as being a lauric diethanolamide, MONAMID 150-ADY which is described as being a mixed fatty acid alkanolamide, MONAMID R31-42 described to be a lauric/myristic diethanolamide, ALKAMIDE L7 described to be a high purity lauric/myristic alkanolamide, ALKAMIDE 2124 described as a lauric diethanolamide, and NINOL 30-LL and NINOL 55-LL, both which are described to be lauric diethanolamides.

Generally, the water soluble alkanolamide constituent is a single surfactant, or is a mixture of such surfactants, which constituent may be included in the spot pretreatment compositions in an amount ranging from about 0.1 to about 10 weight percent, based on the total weight of the spot pretreatment composition. Most preferably, the more water soluble alkoxylated alkanolamide surfactants are employed in an amount ranging from 0.1 to about 9 weight percent, and most preferably, from 1 to 7 weight percent.

The compositions according to the invention include an anionic surfactant constituent. This constituent is selected from alkyl sulfosuccinates, alkyl ether sulfosuccinates, alkylamide sulfosuccinates, alkyl sulfosuccinamates, as well as salt forms thereof. Generally, the alkyl or acyl radical in these various compounds comprise a carbon chain containing 12 to 20 carbon atoms. Many such anionic surfactants are known to the art and are available from a variety of sources, including materials presently commercially available under the tradename ALKASURF, from Rhône-Poulenc Co., as well as those presently commercially available under the tradename MONAWET, from Mona Industries. By way of illustrative example, these include the following: ALKASURF SS-MA-80, which is described to be a sodium dihexyl sulfosuccinate, ALKASURF SS-NO, which is described to be tetrasodium N-alkyl sulfosuccinamate, ALKASURF SS-O, which is described to be sodium dioctyl sulfosuccinate, ALKASURF SS-OA-HE described to be a disodium oleyl amido polyethyleneglycol-2 sulfosuccinate, ALKASURF SS-TA, disclosed as being sodium N-octadecyl sulfosuccinamate, ALKASURF SS-L7DE, which is described as being a sodium sulfosuccinate ester of lauric diethanolamide, ALKASURF SS-L9ME, which is described as being a sodium sulfosuccinate ester of lauric monoethanolamide, ALKASURF SS-L-HE, which is disclosed to be sodium di-isobutyl sulfosuccinate, MONAWET MB-45, described to be diisobutyl sodium sulfosuccinate, MONAWET MM-80, described to be dihexyl sodium sulfosuccinate, MONAWET MO-65-150, which is described to be dioctyl sodium sulfosuccinate, MONAWET MO-70 and MONAWET MO-80, both disclosed to be dioctyl sodium sulfosuccinate, MONAWET MT, described to be di-tridecyl sodium sulfosuccinate, MONAWET SNO-35, described to be a tetrasodium salt of N-(1,2,dicarboxyethyl)N-octadecyl sulfosuccinamate, as well as MONAWET TD-30, described to be an ethoxylated fatty alcohol, half ester of sulfosuccinate acid.

Generally, this anionic surfactant constituent is a single surfactant, or is a mixture of such surfactants, and which is included in the spot pretreatment compositions in an amount ranging from about 0.1 to about 3.5 weight percent, based on the total weight of the spot pretreatment composition. Most preferably, the anionic surfactant constituent is employed in an amount ranging from about 0.1 to about 3 weight percent, and most preferably, from 0.1 to 1 weight percent.

The compositions according to the invention optionally but desirably include one or more fluorosurfactant constitutents as known to the art. By way of non-limiting example these include fluorinated and perfluorinated alkyl carboxylates, fluorinated and perfluorinated alkyl alkoxylates, fluorinated alkyl esters, perfluorinated alkyl sulfonates, fluorinated and perfluorinated alkyl quartemary ammonium iodides, fluorinated alkyl polyoxyethyelene alcohols, as well as salt forms thereof, especially ammonium, alkali and alkaline earth metal salts.

An exemplary useful fluorosurfactant is that presently commercially available under the tradename FLUORAD which includes among other materials various perfluoroalkyl sulfonates, perfluoroalkyl carboxylates and well as salts thereof, and fluorinated alkyl esters. One such material is FC 170C (3M Company, Minneapolis Minn.), which is described as a being a fluorinated alkyl polyoxyethylene ethanol. This material Further useful fluorosurfactants include those presently commercially available under the tradename ZONYL (E.I. DuPont De Nemours & Co., Wilmington Del.).

The fluorosurfactant constituent, when present, may be one or more fluorosurfactants, and it is included in the spot treatment compositions in an amount ranging up to about 1 weight percent, based on the total weight of the spot pretreatment composition. Preferably the fluorosurfactant constituent is present in lesser amounts with amounts of as little as 1–5000 ppm (parts per million) based on the total weight of the spot cleaning compositions have been found to be beneficial.

The compositions according to the invention include an alcohol constituent which is selected to be a water soluble alcohols, desirably a lower alkyl monohydric alcohol including but not limited to straight chained and branched $C_{1-6}$ alcohols which are preferred. Such alcohols, per se, are known to the art and are widely commercially available. Any water soluble alcohol, particularly the preferred $C_{1-6}$ alcohols may be used and incorporated into the spot pretreatment compositions being taught herein and are desirably selected so to exhibit good aqueous solubility, efficacy as a solvent for the removal of certain stains, and particularly desirably to be volatile so that once applied to the soiled garment or textile, readily volatilize therefrom.

The alcohol constituent may be one or more water soluble alcohols, and are included in the spot pretreatment compositions in an amount ranging from about 0.01 to about 7 weight percent, based on the total weight of the composition. The alcohol constituent is desirably included in lower proportions, and preferably it is present in the compositions according to the invention in an amount of about 0.01 to about 7 weight percent, and most preferably, from 2 to 5 weight percent.

The spot pretreatment compositions taught herein also include a glycol ether solvent constituent. Preferred as the glycol ether solvent constituent according to the present invention are glycol ethers according to the general structure $R_a$—O—$R_b$—OH, wherein $R_a$ is an alkyl of 1 to 20 carbon atoms, or aryl of at least 6 carbon atoms, and $R_b$ is an ether condensate such as of a propylene glycol and/or ethylene glycol having from one to ten glycol monomer units. Preferred are $C_3$–$C_{20}$ glycol ethers are those having one, but preferably two to five glycol monomer units. Further examples of particularly preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Exemplary glycol ethers which may be very advantageously employed as the solvent constituent is one or more of the solvents of the group consisting of diethylene glycol methyl ether, ethylene glycol n-butyl ether, diethylene glycol n-butyl ether, ethylene glycol hexyl ether, diethylene glycol hexyl ether, and mixtures thereof. These materials are presently commercially available under the tradenames of DOWANOL from the Dow Chemical Co. (Midland Mich.); CARBITOL or CELLOSOLVE both from Union Carbide Corp. (Danbury Conn.).

The glycol ether solvent constituent is preferably employed in an amount sufficient to sufficiently solubilize the spot pretreatment composition so that it is not overly viscous or gellatious in nature, but rather, exhibits a flow visocosity similar to lower alkyl alcohols or water. Such a viscosity characteristic is particularly beneficial when the spot pretreatment composition is provided in a package or dispenser which includes a dispensing pump or nozzle, and further, facilitates the absorption of the composition amongst the fibers of a a textile or garment. This viscosity characteristic may be achieved in part by the careful selection of one or more glycol ether solvents with particular attention to their solubility characteristics in water, as well as their molecular weights. For example, a formulation within the present invention's scope may have it viscosity lowered by the inclusion of a greater amount of a lower molecular weight glycol ether solvent. At the same time, care should be taken in the selection of the glycol ether solvents so ensure that good stain solubilization properties, including those normally associated with higher molecular weight glycol ethers by desirably ensuring that they are included in the spot pretreatment compositions as well. Thus, with a view to these considerations the selection of a good glycol ether solvent constituent may be made experimental evaluation techniques familiar to those skilled in the art. Generally, the glycol ether component is a single such solvent or is a mixture of such solvents is included in the spot pretreatment compositions in an amount ranging from about 0.01 to about 30 weight percent, based on the total weight of the composition. Most preferably, the glycol ether component is employed in an amount ranging from about 2 to about 18 weight percent, and most preferably, from 3 to 12 weight percent. Desirably, the glycol ether solvent constituent includes approximately equal proportions of two or more different glycol ether solvents of differing molecular weights.

As is noted above, the compositions according to the invention are aqueous in nature. The water may be tap water, but is preferably distilled and is most preferably deionized water. If the water is tap water, it is preferably substantially free of any undesirable impurities such as organics or inorganics, especially minerals salts which are present in hard water which may detract from the operation of the one or more of the essential constituents according to the invention, as well as any other optional components which may be included. Water is added to in sufficient amounts so to provide 100% by weight of the cleaning composition. Desirably, the water forms at least about 70% by weight, and more desirably at least about 74% by weight of the total weight of the spot pretreatment compositions being taught herein.

The spot cleaning compositions may be of an acidic, neutral or alkaline pH, but are desirably at a neutral or alkaline pH, namely of about 7.0 and greater.. More desirably, the spot cleaning compositions have a pH in the range of about 9 to about 11.

The compositions according to the invention may comprise one or more of the following optional components, the total weight of such optional constituents not exceeding about 5% by weight of the total weight of the composition, more preferably not exceeding about 2% by weight and is most preferably less than about 1% by weight based on the total weight of the composition according to the invention. Such optional constituents may be one or more of the following: coloring agents, fragrances (whether natural or synthetically produced), fragrance adjuvants and/or fragrance solubilizers, viscosity modifying agents, thickeners, gelling agents, bleaching and optical brightening agents, pH adjusting agents, pH buffers, water softening agents, biocides, preservatives, as well as further solubilizing agents useful in the solubilization of one or more of the constituents in water. Such materials are well known to the art, and are preferably selected so as not to detract from the other advantageous features of the inventive compositions. Such materials are described, for example in *McCutcheon's Detergents and Emulsifiers,* Vol. 1, North American Edition, 1991; as well as in *McCutcheon's Functional Materials,* Vol. 2, North American Edition, 1991, the contents of which are herein incorporated by reference.

In accordance with a particularly preferred aspect of the invention, there is provided a spot pretreatment composition consisting essentially of the following constituents per 100% wt:

2–7% wt. nonionic alkoxylated phenol or nonionic alkoxylated alcohol,

1–7% wt. nonionic water soluble alkoxylated mono- and/or di-alkanol amide, 0.1–1% wt. anionic surfactant selected from alkyl sulfosuccinates, alkyl ether sulfosuccinates, alkylamide sulfosuccinates, alkyl sulfosuccinamates 0–1% wt. fluorosurfactant 2–5% wt. alcohol solvent 3–12 % wt. glycol ether solvent >70% wt. water.

Desirably, the compositions include an amount of a fluorosurfactant, such that the fluorosurfactant is present in an amount of from >0–1% wt., and more preferably in an amount of about 1–5000 ppm.

The present inventive compositions are simply produced by mixing measured amounts of individual constituents to form a homogenous mixture therefrom. This may be done by well known techniques, and is desirably done in a simple paddle mixer, stirrer or other low shear liquid mixing apparatus so to avoid undesired foaming of the compositions.

With regard to the manner of using the spot pretreatment compositions, said compositions are typically not used in any large amounts as a "general cleaner" but are rather used for the direct treatment of a soil or stained region of a textile or garment. In accordance with one aspect of the process according to the invention, a soiled garment is treated by applying an effective amount of the spot pretreatment composition directly at the location of a stain and optionally onto the surrounding area of the stain. This can be done in one or more of the following ways. One way is simply by means of manually dispensing an effective amount of the spot pretreatment composition directly from a container or vessel directly to the location of the stain. To make such a manual application convenient for the consumer, a number of devices may be used. For example, the spot pretreatment composition may be provided in a spray bottle having a manually operated pump, squeeze bottle, aerosol, or other dispensing container. Such containers are known to the art. In such a way, localized application of the spot pretreatment composition is facilitated and simplified by the requisite operation of the pump of the spray bottle, or by squeezing the squeeze bottle to dispense an amount of the spot pretreatment composition, or by spraying the cleaning composition from the pressurized aerosol container containing the composition according to the invention. A further particularly useful, known art dispensing apparatus is that of a container having a liquid permeable applicator tip or end, such as a porous sponge or porous fabric applicator tip. In use, a removable cap covering the applicator tip is withdrawn, the container inverted to allow the flow of the container's contents to impregnate the permeable applicator tip and the tip is then manually contacted with the stain to both transfer an amount of the spot pretreatment composition, and at the same time to manually agitate or abrade the textile or garment at the locus of the stain and optionally in the surrounding region. Such manually applied agitation provides a mechanical action which acts to physically break up the stain. This is particularly useful for stains which have been left untreated for an extended period of time, i.e., days, weeks, and longer periods, and may have hardened. Such manual agitation, provides in addition to the mechanical loosening of the stain, further acts to improve the penetration of the spot pretreatment composition throughout and among the stained fibers. Such mechanical action also improves the overall stain removal characteristics of the spot pretreatment composition. Due to these beneficial characteristics, containers having a liquid permeable applicator tip or end is particularly preferred, and such containers are known to the art.

In accordance with a further preferred process, a soiled garment is treated by applying an effective amount of the spot pretreatment composition directly at the location of a stain and optionally onto the surrounding area of the stain, and subsequent to such application, a disposable absorbent sheet, or another part of the garment or other garment to manually agitate and "rub in" the spot pretreatment composition so to ensure that it is thoroughly distributed amongst the stain and the fibers at the locus of the stain. Such disposable absorbent sheets may be produced from any fibrous or cellular flexible material which exhibits good absorption of the spot pretreatment composition. For example, such sheets may be non-woven materials such as those which have adhesively bonded fibers in a web accorded fiber structure and/or those which comprise fibrous mats in which the fibers are distributed in a random array. Such a fibrous can be naturally produced fibers including wool, silk, cotton, linen, hemp, sisal, ramie or may be synthetically produced such as synthetically spun fibers of polymers. Examples of such synthetic fibers include rayon, cellulose, polyvinyl derivatives, polyolefins, polyesters, as well as polyamides the production of such two or more different fibers may be used in the production of such non-woven materials. Preferably such sheets are sufficiently strong such that they will resist tearing or separation when used to manually agitate the stain treated with the spot pretreatment compositions as taught in this specification. These sheets, when used, may be of any dimension but are preferably sheets having an area of at least two square centimeters but are preferably ones having greater areas. Sheets having larger areas, i.e., those having areas of at least 50 square centimeters and greater are preferred from the view point of ease of use and handling.

In a further embodiment of the invention, the spot pretreatment compositions may be provided in measured amounts impregnated in a disposable absorbent sheet as described above. In this manner, the spot pretreatment composition may be simultaneously provided to an end consumer with said sheet, and the consumer is then required to impart mechanical force to the locus of the stain on the garment in order to dispense the spot pretreatment composition thereto. In such a manner, the simultaneous provision of an amount of the spot pretreatment composition simultaneously with the mechanical force imparted to both apply the composition and break up the stain may be supplied. A further advantage of such a mode of application is that the absorbent nature of the sheet also acts as a substrate to entrain the loosened stain and remove it from the garment.

Such impregnated disposable absorbent sheets are readily prepared and easily packaged by known art methods. For example, sheets may be impregnated with the spot pretreatment composition by dipping, spraying, coating, pressure treating, vacuum filling or other known method for applying the liquid to the absorbent sheet, and subsequently packaging said sheets into a liquid tight packaging container. Such liquid tight packaging containers may be of any type known to the art, including rigid liquid tight vessels and containers, single opening or resealable bags or pouches, and the like. Of particular mention are single opening pouches which are intended to be torn open by an end consumer, and the absorbent sheet impregnated with the spot pretreatment composition removed in a ready to use form.

In accordance with a further aspect of the invention, the stains on garment or textiles are treated with the spot cleaning compositions as described above in a "pretreatment" step, which is subsequently followed by a laundering or dry cleaning step. Such a laundering step is conventionally known to the art and contemplates the immersion of the garments or textiles in an aqueous wash bath which desirably includes an amount of a detergent composition. Such a dry cleaning step may be one presently conventionally known to the art, as is typically practiced by conventional dry cleaning establishments, such as on a commercial scale. An alternative dry cleaning step may be one which is practiced by a consumer in a home or domestic environment, such as is described in one or more of the patents indicated above, but preferably is one which is practiced utilizing the liquid cleaning compositions particularly useful as a home dry cleaning composition, as well as the processes described in copending U.S. patent application Ser. No. 08/666,689 the contents of which are herein incorporated by reference. In that process, there is disclosed the use of a liquid cleaning composition comprising the following constituents: 0.01–5% wt. (preferably 0.01–2.5% wt.) nonionic surfactant which is preferably an alkoxylated primary or secondary alcohol and/or an alkoxylated phenol; 0.01–2.5% wt. anionic surfacant selected from alkyl sulfosuccinates, alkyl ether sulfosuccinates, alkylamide sulfosuccinates, alkyl sulfosuccinamates, as well as salt forms thereof; 0–1% wt. (preferably 0–0.1% wt.) fluorosurfactant constituent including one or more of those which may be present in the spot cleaning composition; 0.01–7% wt. organic solvent selected from alcohols and glycol ethers especially water miscible alcohols and ethers, to 100% wt. of water, and further up to about 2% wt. (preferably 0–1% wt.) of one or more optional constituents. Desirably, these compositions are aqueous in nature and comprise about 90% wt. and more of water. Such a liquid cleaning composition is advantageously applied to the surface of a garment or textile, particularly at the location of the stains which had been treated utilizing the spot cleaning compositions being taught herein in order to provide a further cleaning effect to the treated garment or textile. They are particularly useful when applied to the surface of a garment or textile which is being tumbled in a vapor permeable or vapor impermeable bag for a sufficient time to generally uniformly wet the garment or textile surface with such a liquid cleaning composition.

The use of such a laundering or dry cleaning step may in some cases be particularly advantageously practiced as the present inventors have observed that the spot cleaning compositions of the invention may leave small amounts of surface residues, or visible rings of a whitish residue at the junction between the dry garment or textile surface and the periphery of the wetted area of a treated stain. Such laundering or dry cleaning step removes any such residues which may form, but other techniques to minimize the formation of such a residue and/or to remove it may be practiced as well. For example, the inventors have found that using an absorbent tipped dispenser in a brush stroking fashion to impart linear strokes minimizes the formation of such a peripheral ring. In such a fashion, the major portion of the spot cleaning composition was supplied to the locus of the stain and lesser amounts of the spot cleaner were supplied to the edges beyond the stain. In such a manner, a "feathered" application of the spot cleaning composition was provided. It is to be noted that a circular or swirling application pattern was not applied to the blouse in order to minimize the likelihood of deforming the textile.

Alternately, should such surface residues, or visible rings of a whitish residue form on a textile surface following the use of the spot cleaning composition being taught herein, such residues may be removed such as by wetting the area of the residue with water, alcohol or other solvent.

As used throughout this specification and in the claims, the use of the terms "garments" and "textiles" are used to describe for example finished articles such as pants, shirts, blouses, scarves, other articles of clothing, apparel, coats, and the like. In the case of the former term, while in the case of the latter term, textiles which are produced but have not been as of yet produced into either pieced goods or finished articles such as articles of clothing or apparel is intended to be meant by the latter term. In either case, as the present invention is equally applicable and useful without distinction or regard for both textiles and/or garments, they are to be understood as to interchangeable terms with respect to the cleaning operations and cleaning compositions according to the instant invention.

As used throughout this specification and claims, references to "parts by weight" and "weight percent" and "% wt." are considered to be interchangeable and to represent the weight percent of a particular constituent with reference to a total composition within which it is included, where such total composition is considered to have 100 parts by weight. In accordance with the immediately preceding description, all of the constituents of each of the formulations described in the examples below are recited in parts by weight and are based on 100 parts by weight of a particular formulation, unless specified to be otherwise.

EXAMPLES

To demonstrate the compositions according to the invention, various formulations were prepared having the constituents which are indicated on Table 1 below wherein the amounts given are the weight percent of each respective constituent.

Preparation of the formulations were performed in a routine manner, which was generally in accordance with the following protocol. To a large glass beaker placed on a magnetic stirrer apparatus was added less than the total amount, or the total amount of deionized water. The temperature of the water, as well as that of the remaining constituents was approximately room temperature (≅68° F., ≅20° C.) The stirrer apparatus was activated, and to the water was added measured amounts of each of the constituents. While order of addition of the constituents is not believed to be important, generally the surfactants were added to the stirring water and allowed to become well dispersed prior to the addition of the remaining constituents. After the addition of the final constituent, the contents of the beaker were allowed to stir for a period of 5 to 15 minutes to ensure homogeneous mixing and the production of a uniform formulation. Each of the formulations was observed to be shelf stable for period of weeks and months.

TABLE 1

| Constituent: | Ex. 1 | Ex. 2 | Ex. 3 | Ex. 4 | Ex. 5 | Ex. 6 | Ex. 7 |
|---|---|---|---|---|---|---|---|
| PolyTergent SL-62 | 4.17 | 4.17 | 4.17 | 4.17 | 4.17 | — | 4.17 |
| PolyTergent SL-22 | 0.83 | 0.83 | 0.83 | 0.83 | 0.83 | — | 0.83 |
| Neodol 25-9 | — | — | — | — | — | 4.17 | — |
| Neodol 25-3 | — | — | — | — | — | 0.83 | — |
| Monamid 150 ADY | 5.00 | — | — | — | — | — | — |
| Monamid 716 | — | 5.00 | 5.00 | 3.50 | 3.50 | 3.50 | 3.00 |
| Monawet SNO-35 | — | — | 0.60 | 0.60 | 0.60 | 0.60 | 0.60 |
| Dowanol DM | 5.00 | 5.00 | 5.00 | 5.00 | 5.00 | 5.00 | 5.00 |
| Hexyl Carbitol | 5.00 | 5.00 | 5.00 | 5.00 | 5.00 | 5.00 | 5.00 |
| Fluorad FC 170c | 0.20 | 0.20 | — | — | — | — | — |
| SDA 40.2 | — | — | 5.00 | — | 3.00 | — | 3.50 |
| deionized water | 79.80 | 79.80 | 74.40 | 80.90 | 77.90 | 79.40 | 77.90 |

TABLE 2

| Constituent: | Ex. 8 | Ex. 9 | Ex. 10 | Ex. 11 | Ex. 12 | Ex. 13 | Ex. 14 |
|---|---|---|---|---|---|---|---|
| PolyTergent SL-62 | — | — | 4.17 | 4.17 | 4.17 | — | 4.17 |
| PolyTergent SL-22 | — | — | 0.83 | 0.83 | 0.83 | 0.83 | 0.30 |
| Tergitol 15-S-9 | 4.17 | — | — | — | — | — | — |
| Tergitol 15-S-3 | 0.83 | — | — | — | — | — | — |
| Neodol 25-9 | — | — | — | — | — | — | — |
| Neodol 25-3 | — | — | — | — | — | — | — |
| Neodol 91-8 | — | 4.17 | — | — | — | — | — |
| Neodol 91-2.5 | — | 0.83 | — | — | — | — | — |
| Monamid R31-42 | — | — | 5.00 | 5.00 | 5.00 | 5.00 | 5.00 |
| Monamid 150 ADY | — | — | — | — | — | — | — |
| Monamid 716 | 3.50 | 3.50 | — | — | — | — | — |
| Monawet SNO-35 | 0.60 | 0.60 | — | — | — | — | 0.60 |
| Dowanol DM | 5.00 | 5.00 | 5.00 | 5.00 | 5.00 | 5.00 | 5.00 |
| Hexyl Carbitol | 5.00 | 5.00 | 5.00 | 5.00 | 5.00 | 5.00 | 5.00 |
| Fluorad FC 170c | — | — | 0.20 | 0.20 | 0.20 | 0.20 | — |
| SDA 40.2 | — | — | — | — | — | — | — |
| citric acid | — | — | 0.20 | 0.10 | — | 0.20 | — |
| hydrogen peroxide | — | — | — | — | — | — | — |
| deionized water | 79.40 | 79.40 | 79.60 | 79.70 | 79.80 | 78.60 | 79.40 |

| Constituent: | Ex. 15 | Ex. 16 | Ex. 17 | Ex. 18 | Ex. 19 | Ex. 20 | Ex. 21* |
|---|---|---|---|---|---|---|---|
| PolyTergent SL-62 | 4.17 | 4.17 | 4.17 | 4.17 | 4.17 | 4.17 | 4.17 |
| PolyTergent SL-22 | 0.83 | 0.83 | 0.83 | 0.83 | 0.83 | 0.83 | 0.83 |
| Tergitol 15-S-9 | — | — | — | — | — | — | — |
| Tergitol 15-S-3 | — | — | — | — | — | — | — |
| Neodol 25-9 | — | — | — | — | — | — | — |
| Neodol 25-3 | — | — | — | — | — | — | — |
| Neodol 91-8 | — | — | — | — | — | — | — |
| Neodol 91-2.5 | — | — | — | — | — | — | — |
| Monamid R31-42 | 5.00 | — | — | — | — | — | — |
| Monamid 150 ADY | — | — | — | — | — | — | — |
| Monamid 716 | | 5.00 | 5.00 | 5.00 | 3.00 | 3.00 | 3.00 |
| Monawet SNO-35 | 0.60 | 0.60 | 0.60 | 0.60 | 0.60 | 0.60 | 0.60 |
| Dowanol DM | 5.00 | 5.00 | 5.00 | 5.00 | 5.00 | 5.00 | 5.00 |
| Hexyl Carbitol | 5.00 | 5.00 | 5.00 | 5.00 | 5.00 | 5.00 | 5.00 |
| Fluorad FC 170c | — | — | — | — | — | — | — |
| SDA 40.2 | — | — | 2.50 | 5.00 | 3.50 | 4.00 | 3.50 |
| citric acid | — | — | — | — | — | — | — |
| hydrogen peroxide | 1.00 | — | — | — | — | — | — |
| deionized water | 78.40 | 79.40 | 76.90 | 74.40 | 77.90 | 77.40 | 77.80 |

*the composition of Ex. 21 further included 0.10% wt. of a fragrance

A particularized listing of the individual constituents and their chemical identity is given in Table 3, below.

TABLE 3

| Constitutent: | |
|---|---|
| PolyTergent SL-62 | alkoxylated linear aliphatic alcohol [100% wt. actives] |
| PolyTergent SL-22 | alkoxylated linear aliphatic alcohol [100% wt. actives] |
| Tergitol 15-S-9 | $C_{11}$–$C_{15}$ secondary alcohol ethoxylate [100% wt. actives] |
| Tergitol 15-S-3 | $C_{11}$–$C_{15}$ secondary alcohol ethoxylate [100% wt. actives] |
| Neodol 25-9 | $C_{12}$–$C_{15}$ linear primary alcohol ethoxylate [100% wt. actives] |
| Neodol 25-3 | $C_{12}$–$C_{15}$ linear primary alcohol ethoxylate [100% wt. actives] |
| Neodol 91-8 | $C_9$–$C_{11}$ linear primary alcohol ethoxylate [100% wt. actives] |
| Neodol 91-2.5 | $C_9$–$C_{11}$ linear primary alcohol ethoxylate [100% wt. actives] |
| Monamid R31-42 | lauric/myristic diethanolamide [80% wt. actives] |
| Monamid 150 ADY | mixed fatty acid alkanolamide [100% wt. actives] |
| Monamid 716 | lauric diethanolamide [100% wt. actives] |
| Monawet SNO-35 | a tetrasodium salt of N-(1,2-dicarboxyethyl)N-octadecyl sulfosuccinamate [35% wt. actives] |
| Dowanol DM | glycol ether [100% wt. actives] |

TABLE 3-continued

| Constitutent: | |
|---|---|
| Hexyl Carbitol | diethylene glycol monohexyl ether [100% wt. actives] |
| Fluorad FC 170c | fluorinated alkyl polyoxyethylene ethanols [95% wt. actives] |
| SDA 40.2 | ethanol [95% wt. actives] |
| citric acid | anhydrous citric acid [100% wt. actives] |
| hydrogen peroxide | aqueous hydrogen peroxide [35% wt. actives] |
| deionized water | deionized water |

Evaluation of spot cleaning characteristics

Cleaning Example 1

An evaluation of the cleaning properties of the formulation according to Example 1 (see Table 1) in accordance with the following general protocol: A clean white rayon blouse was stained in several separate locations with a 0.2 gram amount of a liquid make up (COVER GIRL Ultra Finish Creme Makeup (Soft Beige)). The measured amounts of the makeup was applied at each separate location, and evenly spread with a spatula to form a test stain. The thus stained rayon blouse was then allowed to set at room temperature for 30 minutes to ensure the absorbence of the liquid make up into the fibers of the blouse and to approximate actual consumer conditions for use of the product, who would be understood as likely using the formulations of the invention on stains which have been set and/or dried onto a fabric for an interval of time. Thereafter, an absorbent paper towel sheet was placed on a hard, nonabsorbent surface and a second paper towel sheet was folded twice to form a pad. The blouse was placed on the laid out paper towel sheet such that a test stain was laid on top. Subsequently, 3.0 gram amount of the formulation according to Example 1 was applied directly to the location of a stain using a pipette, and immediately subsequently the folded paper towel pad was used to manually impart forty (40) strokes of the pad in a variety of directions so to mechanically agitate the stain on the blouse and to ensure that the formulation was interspersed among the rayon fibers. Thereafter, the absorbent paper towel was removed from beneath the stain and both the folded paper towel pad and the absorbent paper towel was inspected. It was noticed that a substantial portion of the liquid make up was removed and was now entrained or absorbed on one or both of the paper towels.

By visual inspection, the test stain was observed to have been completely removed from the rayon blouse leaving only a wetted circular area resulting from the application of the of the formulation according to Example 1. Immediately subsequently the surface of the rayon blouse was sprayed with a sufficient amount of a liquid cleaning composition as taught in copending application U.S. Ser. No. 08/666,689 and which generally comprised the following constituents: 0.01–5% wt. (preferably 0.01–2.5% wt.) nonionic surfactant which is preferably an alkoxylated primary or secondary alcohol and/or an alkoxylated phenol; 0.01–2.5% wt. anionic surfacant selected from alkyl sulfosuccinates, alkyl ether sulfosuccinates, alkylamide sulfosuccinates, alkyl sulfosuccinamates, as well as salt forms thereof; 0–1% wt. (preferably 0–0.1% wt.) fluorosurfactant constituent including one or more of those which may be present in the spot cleaning composition; 0.01–7% wt. organic solvent selected from alcohols and glycol ethers especially water miscible alcohols and ethers, to 100% wt. of water, and further up to about 2% wt. (preferably 0–1% wt.) of one or more optional constituents. The thus treated rayon blouse was then placed into the interior of a vapor impermeable containment bag, whose opening was sealed to retain the blouse within the interior of said bag, and the containment bag and its contents were supplied to the interior of conventional, horizontally rotating clothes drying apparatus on a "fluff" cycle for 5–15 minutes. No heat was applied. During this step the rayon blouse freely tumbled within the containment bag which was observed to billow and expand, which in turn itself freely tumbled within the rotating drum of the dryer apparatus.

The dryer was then halted, the containment bag withdrawn and the rayon blouse was extracted from the bag. It was generally uniformly wetted, and it was placed on a clothes hanger and permitted to dry. After drying, the blouse was closely inspected. No yellowing was observed in the fabric, and no whitish rings or "fronts" were observed. These results were judged to be "excellent" cleaning results.

Cleaning Example 2

In the same manner as that outlined above for Cleaning Example 1, a further evaluation was performed utilizing a 3.0 gram sample of the formulation according to Example 14 (Table 2) was also evaluated for its efficacy in removing the same liquid make up stain on the rayon blouse. In accordance with the general procedures therein described, stain removal was effectuated and it was observed that essentially all of the liquid make up had become entrained on one or both of the paper towels.

Within several minutes after treatment with spot cleaning composition according to Example 14, the surface of the rayon blouse was sprayed using a quantity of the liquid cleaning composition as taught in copending application U.S. Ser. No. 08/666,689 and described in Example 1, above. The rayon blouse was similarly provided to a containment bag, and subsequently treated as generally described in Example 1.

Subsequent to drying, the stain cleaning efficacy of the formulation of Example 14 was also judged to provide "excellent" cleaning results. Again, no whitish rings or "fronts" were observed at the periphery of this wetted circular area formed by the formulation after the blouse was allowed to dry.

Cleaning Example 3

Following the general protocol and again utilizing the liquid cleaning composition described for Cleaning Example 1, a sample of the formulation according to Example 15 (see Table 2) was evaluated for its spot cleaning efficacy on a rayon blouse with the same test stains as in Cleaning Example 1.

Following the conclusion of the spot cleaning operation, a substantial portion of the liquid make up was again noted to have been absorbed upon one or both of the paper towel surfaces, and the stain was observed to have been totally removed.

Subsequent to the treatment of the rayon blouse with the liquid cleaning composition and in the manner described in Cleaning Example 1, the spot cleaning results were observed to be "excellent" as the formulation according to Example 15 essentially removed all of the liquid make up stain from the rayon blouse. Also, no whitish rings or "fronts" were observed at the periphery of the wetted circular area formed by the formulation after the blouse was allowed to dry.

Cleaning Example 4

Formulations according to the invention were evaluated as to their cleaning performance in the removal of a red lipstick stain (MAYBELLINE Royal Garnet) applied to a white rayon blouse. In accordance with this evaluation, a clean white rayon blouse was stained at several locations with red lipstick using uniform amounts of the lipstick applied manually. The thus stained blouse was allowed to set for approximately 10 minutes, which again simulated an actual consumer in-use condition, where it is expected that dried stains would likely be treated by the inventive formulations.

Subsequent to the 10 minute period, a clean paper towel sheet was placed on a hard nonabsorbent surface, and a second paper towel was folded over to form a pad therefrom. A portion of the blouse with the stain facing upwards was placed on the paper towel sheet, and 3 gram sample of the formulation according to Example 14 (see Table 2) was applied directly to the stain. Immediately subsequently, the paper towel pad was manually stroked 40 times in order to sufficiently rub the formulation into the stain and amongst the fibers of the rayon blouse. Subsequent to this cleaning operation, the paper towels were removed from the locus of the stain and they were visually inspected. It was observed that all of the red lipstick was removed onto one or both of the paper towel surfaces and that the white rayon blouse at the location of the prior stain was clean and was only wetted by the absorbed formulation.

Subsequently, the rayon blouse was treated with the liquid cleaning composition and further processed in the manner described in Cleaning Example 1. Following the removal of the rayon blouse from the containment bag and drying of the rayon blouse, the efficacy of the spot cleaning results were observed to be "excellent" as the formulation according to Example 15 essentially removed all of the red lipstick stain from the rayon blouse. Also, no whitish rings or "fronts" were observed at the periphery of the wetted circular area formed by the formulation after the blouse was allowed to dry.

Cleaning Example 5

In accordance with the initial protocol outlined for Cleaning Example 4, the same protocol was followed but for the use of a 3.0 gram sample of the formulation according to Example 15.

Similarly, following the stroking of the locus of the stain with the absorbent paper towel pad, the paper towel was removed from beneath the stain as well as the pad. Both were observed to have entrained thereupon substantially all of the red lipstick which had been substantially removed from the white rayon blouse, leaving only behind the wetted portion due to the entrained formulation. The white rayon blouse was not subsequently treated with the liquid cleaning composition as described in Cleaning Example 4.

Following the drying of the wetted area, whitish rings or "fronts" were observed at the periphery of the wetted circular area formed by the formulation after the blouse was allowed to dry.

Cleaning Example 6

Further evaluations to judge the cleaning efficacy of certain formulations according to the invention were performed in accordance with the following protocol. A further clean white rayon blouse was stained at several locations by the several applications of 0.02 gram amounts of a liquid make up (COVER GIRL Ultra Finish Creme Makeup (Soft Beige)). Afterwards, the thus stained blouse was allowed to lie undisturbed for a 10 to 15 minute interval in order to permit the stains to set, and to approximate actual in-use consumer conditions. Afterwards at the locus of one stain, a clean paper towel was placed on a hard nonabsorbent surface underneath said stain and a second paper towel was folded over twice to form a paper towel pad. To the stain, were provided a 3.0 gram sample of the formulation according to Example 14 (see Table 2) and immediately after such application the stain was manually rubbed with the paper towel pad fifty (50) strokes in order to mechanically agitate the stain and to ensure the penetration of the formulation in to the stain and amongst the rayon fibers. Afterwards, both of the paper towels were removed and were visually observed to have essentially entrained thereupon all of the liquid make up, and that the stain was essentially completely removed from the rayon blouse.

Within several minutes after treatment with spot cleaning composition according to Example 14, the surface of the rayon blouse was sprayed using a quantity of the liquid cleaning composition as taught in copending application U.S. Ser. No. 08/666,689 and described in Example 1, above. The rayon blouse was similarly provided to a containment bag, and subsequently treated as generally described in Example 1.

Subsequent to drying, the stain cleaning efficacy of the formulation of Example 16 was also judged to provide "excellent" cleaning results. Again, no whitish rings or "fronts" were observed at the periphery of this wetted circular area formed by the formulation after the blouse was allowed to dry.

Cleaning Example 7

Similarly, using the same protocol as defined for Cleaning Example 6 immediately above, a 3.0 gram sample of the formulation according to Example 16 (see Table 2) was used to treat a liquid make up test stain up (COVER GIRL Ultra Finish Creme Makeup (Soft Beige)) on a white rayon blouse. Subsequent to the cleaning operation, a visual inspection of both of the paper towels showed that essentially all of the liquid make up had been removed from the rayon blouse and had become absorbed onto one or both of the paper towel surfaces. These cleaning results were judged to be "excellent". Further, no whitish rings or "fronts" were observed at the periphery of the wetted circular area formed by the formulation after the blouse was allowed to dry.

Cleaning Examples 8–11

The evaluation of further formulations according to the invention on various fabric substrates were performed on individual fabric swatch composed of rayon, silk, polyester/cotton blend, and wool provided with test stains in accordance with the following protocol. To each swatch was applied at one region a 2.0 gram amount of a liquid make up (COVER GIRL Ultra Finish Creme Makeup (Soft Beige)). and at another region of each swatch was applied a 5.0 gram sample of a tomato sauce (RAGU Old World Style Spaghetti Sauce). Each fabric swatch was allowed to sit undisturbed for two hours, allowing the make up and the tomato sauce to become absorbed. Afterwards, each of the fabric swatches was placed with the stains facing upward upon a separate absorbent paper towel laid out upon a flat hard surface, with the swatch approximately centered upon the paper towel. To the liquid makeup test stain on an individual fabric swatch, using a pipette 0.2 grams of the formulation according to Example 16 (see Table 2) was dispensed directly onto the stain. Shortly thereafter, a second paper towel folded twice to form an absorbent pad was used to manually rub the stain with 40 strokes after which the folded paper towel pad was removed and observed visually. Afterwards, a 2.0 gram sample of the formulation according to Example 16 was applied to the tomato sauce stain on the same swatch and using a second folded paper towel likewise folded to form an absorbent pad, the formulation was rubbed into the stain using 40 strokes and again, the pad was removed and observed. This protocol was repeated for each of the fabric swatches until the formulation according to Example 16 was used to clean both of the stains on each of the four swatches evaluated. For sake of convenient reference, the rayon swatch is designated to be Cleaning Example 8, the silk swatch is designated to be Cleaning Example 9, the polyester/cotton blend swatch is designated to be Cleaning Example 10, and the wool swatch is designated to be Cleaning Example 11.

In each of the Cleaning Examples 8–11, one or both of the paper towels were observed to have entrained thereupon the individual stains on each of the fabric swatches, and in each case both of the test stains were visually determined to have been substantially removed from the fabric.

Each of these individual cleaning results were judged to be "excellent".

Afterwards, each of the swatches was sprayed using a quantity of the liquid cleaning composition as taught in copending application U.S. Ser. No. 08/666,689 and described in Example 1, above. The swatches were similarly provided to a containment bag, and subsequently treated as generally described in Example 1.

After the swatches were allowed to dry, no whitish rings or "fronts" were observed at the periphery of the wetted circular area formed by the formulation Cleaning Examples 12–15

The protocol associated with Cleaning Examples 8–11 above, regarding to the preparation of test stained swatches of several textile swatches was repeated using four new swatches, one each of rayon, silk, a polyester/cotton blend, and wool. For sake of convenient reference, the rayon swatch is designated to be Cleaning Example 12, the silk swatch is designated to be Cleaning Example 13, the polyester/cotton blend swatch is designated to be Cleaning Example 14, and the wool swatch is designated to be Cleaning Example 15. As above, each was stained with liquid make up and with tomato sauce and following a two hour set, was cleaned in the same manner, however, using a 2.0 gram sample of the formulation according to Example 17 (see Table 2).

Following the rubbing in (stroking) of the formulation, each of the paper towels were observed to have entrained thereupon substantially all of the test stains from each of the fabric swatches, and each of the stains on each of the fabric swatches was observed to have been substantially removed. Each of these individual cleaning results were judged to be "excellent".

Afterwards, each of the swatches was sprayed using a quantity of the liquid cleaning composition as taught in copending application U.S. Ser. No. 08/666,689 and described in Example 1, above. The swatches were similarly provided to a containment bag, and subsequently treated as generally described in Example 1.

After the swatches were allowed to dry, no whitish rings or "fronts" were observed at the periphery of the wetted circular area formed by the formulation Cleaning Example 16

A formulation according to the invention, namely a formulation according to Example 16 (Table II) was evaluated in conjunction with the following protocol.

A clean white rayon blouse was laid on a flat surface, and a 3.0 gram sample of the formulation according to Example 16 was dropped on to the middle of one of the sleeves using a pipette to form a circle of wetted rayon. Afterwards, using a paper towel folded twice to form an absorbent pad therefrom, the formulation was worked into the sleeve by stroking it approximately 40 times thus to ensure the complete interspersal of the formulation amongst the fibers of the blouse. This is allowed to sit for several minutes after which was applied over the complete surface of the sleeve a "post-treatment" formulation having the following composition:

| "Post Treatment" formulation | |
|---|---|
| MONAWET SNO-35 | 0.16% wt |
| SD 40-2 | 2.0% wt |
| PolyTergent SL-22 | 0.021% wt |
| PolyTergent SL-62 | 0.1% wt |
| deionized water | to 100% wt |

This "post treatment" formulation was applied on the surface of the sleeve particularly in the region of the area wetted by the formulation of Example 16 using a finger pumpable trigger spraying device in sufficient amounts wherein the sleeve showed light but uniform wetting. Afterwards, the thus treated rayon blouse was inserted into a large white polyethylene bag and the open end sealed. Immediately afterwards, the bag was inserted into the interior of a conventional, horizontally rotating clothes drying apparatus and the dryer was operated on a "low" setting for 30 minutes after which the dryer was stopped and the contents of the bag withdrawn.

By inspection, there was no observable ring or whitish residue upon the treated sleeve of the rayon blouse, and no yellow stain tint was observed.

Cleaning Example 17, Comparative Cleaning Examples I and II

The cleaning evaluation of a formulation according to the invention was evaluated as against two commercially available formulations. The first commercially available formulation was SHOUT a laundry pre-treatment product currently marketed by SC Johnson & Co., Racine Wis. and was designated "Comparative Formulation I". The second commercially available formulation, SPRAY 'N WASH a further laundry pre-treatment product currently marketed by DOW, Midland Mich., which was designated "Comparative Formulation II". These formulations were evaluated against the formulation according to Example 16 (Table 2) using the following testing procedure.

On three 3 by 5 inch fabric swatches, one each of a polyester/cotton blend, one of rayon, and one of silk were placed at opposite regions 0.003 grams of a red lipstick to form a lipstick stain, and on another region on the swatch 0.01 grams liquid make up to form a liquid makeup test stain. The stains were allowed to set into the fabric for five minutes before any cleaning operation.

Subsequently, each of the fabric swatches were first placed upon an absorbent paper towel sheet which itself was placed on a hard non-absorbent surface with the stain facing upwards. Utilizing a small bottle having a dispenser applicator of a brush tricot fabric on a screw-on applicator and which permitted the flow of the contents of the bottle to flow therethrough and into the absorbent applicator. Each of the stains was treated in a like manner wherein the bottle was inverted to permit the flow of its contained material to the applicator and then stroked approximately 40 times using a light manual action. For the "SHOUT" product which was a gel, due to its viscosity, an amount was pipetted out on to the locus of the stain and a clean but empty applicator tip was used to agitate the stain and the textile. After each of the applications, the fabric swatch was separated from the absorbent paper towel underneath and visually inspected.

It was observed that the formulation according to Example 16 was observed to be the fastest acting of the three formulations tested as it most quickly and thoroughly remove the stain compared to either of the commercially available, SHOUT and SPRAY 'N WASH compositions. Further, it was observed that subsequent to drying, for the polyester cotton swatches, visible stain fronts were retained by both the SHOUT and SPRAY 'N WASH compositions, whereas the stain was completely removed by the formulation according to Example 16.

Cleaning Examples 18, 19; Comparative Cleaning Examples III, IV

The cleaning efficacy of two spot cleaning compositions according to the invention, one at an acidic pH, the other at an alkaline pH were compared against two different prior art spot cleaning compositions. The composition of Cleaning Example 18 was at a pH of 10.5, in an "as is" spot cleaning formulation of Example 21. The composition of Cleaning Example 19 was a spot cleaning formulation according to Example 21 which was adjusted using an minor amount of an acid to a pH of 5.0. The first comparative composition, indicated as "Comparative Cleaning Example III" was an aqueous hydrogen peroxide preparation of 1–5% $H_2O_2$, while a further "Comparative Cleaning Example IV" was a liquid composition extracted from a commercially available product believed to be in accordance with the formulations indicated in U.S. Pat. No. 5,238,587. In the evaluation of this test individual 5 by 5 inch swatches of wool, rayon, silk, or a blend of polyethylene terephthalate-cotton (PET-cotton) fibers were stained with amounts of the following: 0.3 grams lipstick, 0.2 grams of a liquid make up composition, 0.5 grams of spaghetti sauce, 0.5 grams of salad dressing, 0.25 grams mayonnaise, 0.25 grams mustard, 0.20 grams coffee, a ball point pen ink composition, ten strokes of a cosmetic blush composition, 0.15 grams olive oil, and 0.20 grams of a red wine. In each case, these materials were applied individually to the individual swatches and allowed to age for 24 hours in an undisturbed state.

Wool and rayon swatches were stained only with lipstick, make up, blush, pen ink, mayonnaise and coffee stains. Blended fiber swatches of polyethylene terephthalate-cotton (PET-cotton) and silk were stained with each of the staining compositions noted above.

Subsequent to this 24 hour period, individual swatches was treated using 3 grams of one of the spot cleaning compositions indicated above. Each of these individual formulations was applied using a porous applicator tip inserted on the top of a small plastic bottle which contained a quantity of the particular spot cleaning composition. Each of the tested spot cleaning compositions were readily absorbed and passed through this porous applicator tip, which was used to apply the spot cleaning composition by supplying 50 circular rubs with the porous applicator tip at the location of the stain on each individual swatch.

Subsequently, on a flat surface, the four individual swatches of like textile substrate and of a like original stain were laid in horizontal rows. Afterwards, each of five panelists was asked to rank these treated swatches and stains from "best cleaning" which assigned a numerical rank value of 1, "good" cleaning assigned a rank value of 2, "fair cleaning" assigned a ranking value of 3, and "worst cleaning" which was assigned a numerical ranking value of 4.

After this ranking, the numerical average of the ranking value assigned for a particular cleaning example or comparative cleaning example on a specific substrate was determined and these results are reported on Table 4 below.

TABLE 4 average of rank order panel results (24 hour aged stains)

| textile | spot cleaning composition: | | | |
|---|---|---|---|---|
| substrate: | CI. Ex. 18 | CI. Ex. 19 | Comp. CI. III | Comp. CI. IV |
| PET-cotton | 1.65 | 2.09 | 2.12 | 3.72 |
| Silk | 1.48 | 2.5 | 2.27 | 3.45 |
| Rayon | 1.63 | 2.23 | 2.6 | 3.53 |
| Wool | 1.40 | 2.33 | 3.03 | 3.13 |

As may be seen by a visual inspection of these results, the cleaning results of the spot cleaning compositions according to the invention were favorable, but for most stains and textile substrates were ranked by the panelists to be superior spot cleaning compositions than prior art compositions.

Cleaning Example 20, Comparative Cleaning Example V

In a manner similar to that described above, four different textile substrate swatches, namely silk, rayon, wool and a blend of polyethylene terephthalate-cotton were each individually stained with one of the following staining materials as generally described above: 0.03 g lipstick; 0.20 g of a cosmetic makeup preparation; 0.5 g of a spaghetti sauce, 0.20 g red wine, 0.25 g mustard, or 0.5 g of a salad dressing. These stained swatches were then permitted to rest undisturbed for a period of seven (7) days, during which time these stains dried and hardened.

Subsequently, each of these stained swatches was treated with one of two spot cleaning compositions, either that according to Ex. 21 or a prior art which was extracted from a commercially available product believed to be in accordance with the formulations indicated in U.S. Pat. No. No. 5,238,587 and designated as Comparative Cleaning Example V.

Generally in accordance with the protocol outlined above, each of the individual swatches was treated using 3 grams of one of the spot cleaning compositions indicated above. Each of these individual formulations was applied using a porous applicator tip inserted on the top of a small plastic bottle which contained a quantity of the particular spot cleaning composition. Each of the tested spot cleaning compositions were readily absorbed and passed through this porous applicator tip, which was used to apply the spot cleaning composition by supplying 50 circular rubs with the porous applicator tip at the location of the stain on each individual swatch.

Subsequently, on a flat surface, the two individual swatches of like textile substrate and of a like original stain were laid in horizontal rows. Afterwards, each of five panelists was asked to rank these treated swatches and stains from "best cleaning" which assigned a numerical rank value of 1, and "worst cleaning" which was assigned a numerical ranking value of 2.

The results of this ranking is indicated on Table 5, below.

TABLE 5

| PET-Cotton swatch | Panelist A | Panelist B | Panelist C | Panelist D | Panelist E | Individual Average for stain/ substrate: | Average for all stains on substrate: |
|---|---|---|---|---|---|---|---|
| Textile Swatches with spot cleaning composition of Ex. 21 | | | | | | | |
| Red Wine | 1 | 1 | 1 | 1 | 1 | 1 | |
| Mustard | 1 | 1 | 1 | 1 | 0 | 0.8 | |
| Spag Sauce | 1 | 1 | 1 | 1 | 1 | 1 | |
| Salad Dres | 1 | 1 | 1 | 1 | 1 | 1 | |
| Lipstick | 1 | 1 | 1 | 1 | 1 | 1 | |
| Make Up | 1 | 1 | 1 | 1 | 1 | 1 | 0.97 |
| Silk swatch | | | | | | | |
| Red Wine | 1 | 1 | 1 | 1 | 1 | 1 | |
| Mustard | 1 | 0 | 1 | 1 | 1 | 0.8 | |
| Spag Sauce | 1 | 1 | 1 | 1 | 1 | 1 | |
| Salad Dres | 1 | 1 | 1 | 1 | 1 | 1 | |
| Lipstick | 1 | 1 | 1 | 1 | 1 | 1 | |
| Make Up | 1 | 1 | 1 | 1 | 1 | 1 | 0.97 |
| Rayon swatch | | | | | | | |
| Red Wine | 2 | 0 | 2 | 0 | 0 | 0.8 | |
| Mustard | 1 | 1 | 1 | 1 | 1 | 1 | |
| Spag Sauce | 1 | 1 | 1 | 1 | 1 | 1 | |
| Salad Dres | 1 | 1 | 1 | 1 | 1 | 1 | |
| Lipstick | 1 | 1 | 1 | 1 | 1 | 1 | |
| Make Up | 1 | 1 | 1 | 1 | 1 | 1 | 0.97 |
| Wool swatch. | | | | | | | |
| Red Wine | 1 | 1 | 1 | 1 | 1 | 1 | |
| Mustard | 1 | 1 | 1 | 1 | 1 | 1 | |
| Spag Sauce | 1 | 1 | 1 | 1 | 1 | 1 | |
| Salad Dres | 1 | 1 | 1 | 1 | 1 | 1 | |
| Lipstick | 1 | 1 | 1 | 1 | 1 | 1 | |
| Make Up | 1 | 1 | 1 | 1 | 1 | 1 | 1.00 |
| Textile Swatches with spot cleaning composition of Comp. CI. Ex. V | | | | | | | |
| Red Wine | 2 | 2 | 2 | 2 | 2 | 2 | |
| Mustard | 2 | 2 | 2 | 2 | 0 | 1.60 | |
| Spag Sauce | 2 | 2 | 2 | 2 | 2 | 2 | |
| Salad Dres. | 2 | 2 | 2 | 2 | 2 | 2 | |
| Lipstick | 2 | 2 | 2 | 2 | 2 | 2 | |
| Make Up | 2 | 2 | 2 | 2 | 2 | 2 | 1.93 |
| Silk swatch | | | | | | | |
| Red Wine | 2 | 2 | 2 | 2 | 2 | 2 | |
| Mustard | 2 | 0 | 2 | 2 | 2 | 1.60 | |
| Spag Sauce | 2 | 2 | 2 | 2 | 2 | 2 | |
| Salad Dres. | 2 | 2 | 2 | 2 | 2 | 2 | |
| Lipstick | 2 | 2 | 2 | 2 | 2 | 2 | |
| Make Up | 2 | 2 | 2 | 2 | 2 | 2 | 1.93 |
| Rayon swatch | | | | | | | |
| Red Wine | 1 | 0 | 1 | 0 | 0 | 0.40 | |
| Mustard | 2 | 2 | 2 | 2 | 2 | 2 | |
| Spag Sauce | 2 | 2 | 2 | 2 | 2 | 2 | |
| Salad Dres. | 2 | 2 | 2 | 2 | 2 | 2 | |
| Lipstick | 2 | 2 | 2 | 2 | 2 | 2 | |
| Make Up | 2 | 2 | 2 | 2 | 2 | 2 | 1.73 |
| Wool swatch | | | | | | | |
| Red Wine | 2 | 2 | 2 | 2 | 2 | 2 | |
| Mustard | 2 | 2 | 2 | 2 | 2 | 2 | |
| Spag Sauce | 2 | 2 | 2 | 2 | 2 | 2 | |
| Salad Dres. | 2 | 2 | 2 | 2 | 2 | 2 | |
| Lipstick | 2 | 2 | 2 | 2 | 2 | 2 | |
| Make Up | 2 | 2 | 2 | 2 | 2 | 2 | 2.00 |

As can be seen in this side-by-side comparison, the spot cleaning compositions of the present invention have been rated to significantly outclean and outperform the prior art formulations.

This is particularly important as is known to the general cleaning art, stains which have been aged for a significant period of time generally in excess of at least 24 hours and more generally several days while on the one hand is more representative of the respective treatment to be afforded to by consumers as to stained garments and textiles in a dry cleaning operation, while at the same time more difficult to remove due to the aging and hardening of the stains on the garments or textiles. As such, and as is readily evidenced by the results indicated in Tables IV and V, the spot cleaning compositions of the invention are excellent, not only as spot cleaning compositions useful for stains which are "fresh", but perhaps even more significantly are excellent spot cleaning compositions for "aged" stains for a wide variety of textile substrates.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. A spot pretreatment composition comprising:

0.1–10% wt. nonionic alkoxylated alcohol or phenol;

0.1–10% wt. nonionic alkoxylated mono- and/or di-alkanol amide;

0.1–3.5% wt. anionic surfactant selected from the group consisting of alkyl sulfosuccinate, alkyl ether sulfosuccinate, alkylamide sulfosuccinate, alkyl sulfosuccinamate, and salt forms thereof;

0–1% wt. fluorosurfactant;

0.01–7% wt. alcohol solvent;

0.01–30% wt. glycol ether solvent;

to 100% wt. water.

2. The spot pretreatment composition according to claim 1 which further comprises:

0–5% wt. of one or more optional constituents selected from coloring agents, fragrances, fragrance adjuvants, fragrance solubilizers, viscosity modifying agents, thickeners, gelling agents, bleaching agents, optical brightening agents, pH adjusting agents, pH buffers, water softening agents, biocides, preservatives, and further solubilizing agents.

3. The spot pretreatment composition according to claim 1 wherein the nonionic alkoxylated alcohol or phenol constituent is one or more alkoxylated phenols.

4. The spot pretreatment composition according to claim 1 wherein the nonionic alkoxylated alcohol constituent is selected from one or more alkoxylated primary alcohols, alkoxylated secondary alcohols or alkoxylated tertiary alcohols.

5. The spot pretreatment composition according to claim 1 wherein the nonionic alkoxylated alcohol or phenol is present in an amount of from 0.1 to 9% wt.

6. The spot pretreatment composition according to claim 1 wherein the nonionic alkoxylated alcohol or phenol is present in an amount of from 2 to 7% wt.

7. The spot pretreatment composition according to claim 1 wherein nonionic alkoxylated mono- and/or di-alkanol amide constituent is present in an amount of from 0.1 to 9% wt.

8. The spot pretreatment composition according to claim 1 wherein the nonionic alkoxylated mono- and/or di-alkanol amide constituent is present in an amount of from 1 to 7% wt.

9. The spot pretreatment composition according to claim 1 wherein the anionic surfactant constituent is present in an amount of from 0.1 to 3% wt.

10. The spot pretreatment composition according to claim 1 wherein the anionic surfactant constituent is present in an amount of from 0.1 to 1% wt.

11. The spot pretreatment composition according to claim 1, wherein the fluorosurfactant constituent is selected from the group consisting of fluorinated and perfluorinated alkyl carboxylates, fluorinated and perfluorinated alkyl alkoxylates, fluorinated alkyl esters, perfluorinated alkyl sulfonates, fluorinated and perfluorinated alkyl quaternary ammonium iodides, fluorinated alkyl polyoxyethylene alcohols, and salt forms of any of aforesaid compounds capable of forming a salt.

12. The spot pretreatment composition according to claim 1 wherein the fluorosurfactant constituent is present in an amount of from 1–5000 parts per million.

13. The spot pretreatment composition according to claim 1 wherein the alcohol solvent constituent is a lower alkyl monohydric alcohol.

14. The spot pretreatment composition according to claim 13 wherein the alcohol solvent constituent is a straight chained or branched $C_{1-6}$ alcohol.

15. The spot pretreatment composition according to claim 13 wherein the alcohol solvent constituent is present in an amount of from 2 to 5% wt.

16. The spot pretreatment composition according to claim 1 wherein the glycol ether solvent constituent is selected from glycol ethers according to the general structure, $$R_a—O—R_b—OH,$$

wherein:

$R_a$ is an alkyl of 1 to 20 carbon atoms, or aryl of at least 6 carbon atoms, and $R_b$ is an ether condensate of a propylene glycol and/or ethylene glycol having from one to ten glycol monomer units.

17. The spot pretreatment composition according to claim 1 wherein the glycol ether solvent constituent is selected from $C_3$–$C_{20}$ glycol ethers having one to five glycol monomer units.

18. The spot pretreatment composition according to claim 1 wherein the glycol ether solvent constituent are two or more different glycol ethers having different molecular weights.

19. The spot pretreatment composition according to claim 1 wherein the glycol ether solvent constituent is present in an amount of from about 2 to about 18% wt.

20. The spot pretreatment composition according to claim 1 wherein the glycol ether solvent constituent is present in an amount of from about 3 to about 12% wt.

21. The spot pretreatment composition according to claim 1 where said composition has a pH in the range of about 7.0 and greater.

22. The spot pretreatment composition according to claim 1 where said composition has a pH in the range of about 9 to about 11.

23. A process for the treatment of a stain on a garment or textile which comprises the step of:

contacting the garment or textile with the spot pretreatment composition according to claim 1.

24. A process for the treatment of a stain on a garment or textile according to claim 23 which further comprises the step of:

subsequently laundering or dry-cleaning the garment or textile treated with the spot cleaning composition.

25. The process according to claim 23 which includes the further process steps of:

inserting the textile or garment into the interior of a containment bag, providing a quantity of a home dry cleaning composition to the interior of the containment bag, closing the containment bag, inserting the containment bag containing the textile or garment to the interior of a dryer apparatus, and, operating the dryer apparatus to tumble and distribute the home dry cleaning composition to the surface of the textile or garment contained in the containment bag.

26. The process according to claim 25 which includes the further process step of:

providing a dispenser means.

27. A home dry cleaning kit which includes a containment bag, a quantity of a spot cleaning composition according to claim 1, a quantity of a liquid cleaning composition useful for home dry cleaning, and a dispenser means for dispensing the liquid cleaning composition to garments or textiles.

28. A spot pretreatment composition consisting essentially of:

2–7% wt. nonionic alkoxylated phenol or nonionic alkoxylated alcohol;

1–7% wt. nonionic water soluble alkoxylated mono- and/or di-alkanol amide;

0.1–1% wt. anionic surfactant selected from the group consisting of alkyl sulfosuccinates, alkyl ether sulfosuccinates, alkylamide sulfosuccinates, and alkyl sulfosuccinamates ;

0.0001–1% wt. fluorosurfactant;

2–5% wt. alcohol solvents;

3–12% wt. glycol ether solvents;

at least 70% wt. water.

29. A spot pretreatment composition according to claim 28 which comprises 1–5000 ppm of a fluorosurfactant.

30. A spot pretreatment composition comprising:

0.1–10% wt. nonionic alkoxylated alcohol or phenol;

0.1–10% wt. $C_8$–$C_{24}$ alkyl-di($C_2$–$C_3$ alkanol amides);

0.1–3.5% wt. anionic surfactant selected from the group consisting of alkyl sulfosuccinates, alkyl ether sulfosuccinates, alkylamide sulfosuccinates, and alkyl sulfosuccinamates;

0–1% wt. fluorosurfactant;

0.01–7% wt. alcohol solvent;

0.01–30% wt. glycol ether solvent;

to 100% wt. water.

31. A spot pretreatment composition comprising:

0.1–10% wt. nonionic alkoxylated alcohol or phenol;

0.1–10% wt. $R_1$—CO—NH—$R_2$—OH where:

$R_1$ is a branched or straight chain $C_8$–$C_{24}$ alkyl radical; and $R_2$ is a $C_1$–$C_4$ alkylene radical;

0.1–3.5% wt. anionic surfactant selected from the group consisting of alkyl sulfosuccinates, alkyl ether sulfosuccinates, alkylamide sulfosuccinates, and alkyl sulfosuccinamates;

0–1% wt. fluorosurfactant;

0.01–7% wt. alcohol solvent;

0.01–30% wt. glycol ether solvent;

to 100% wt. water.

32. The spot pretreatment composition according to claim 31 wherein $R_1$ is a $C_{10}$–$C_{16}$ alkyl radical.

33. The spot pretreatment composition according to claim 31 wherein $R_2$ is an ethylene radical.

* * * * *